United States Patent [19]

Kamohara et al.

[11] Patent Number: 5,077,497

[45] Date of Patent: Dec. 31, 1991

[54] CATHODE RAY TUBE

[75] Inventors: Eiji Kamohara; Shinpei Koshigoe, both of Fukaya; Taketoshi Shimona, Isesaki, all of Japan

[73] Assignee: Kabushiki Kaisha Toshiba, Kawasaki, Japan

[21] Appl. No.: 430,284

[22] Filed: Nov. 2, 1989

[30] Foreign Application Priority Data

Nov. 2, 1988 [JP] Japan ..... 63-277922
Aug. 21, 1989 [JP] Japan ..... 1-212955

[51] Int. Cl.[5] ..... H01J 29/46

[52] U.S. Cl. ..... 315/3; 315/59; 313/414; 313/447

[58] Field of Search ..... 315/3, 59, 71; 313/414, 313/444, 447

[56] References Cited

U.S. PATENT DOCUMENTS 3,932,786 1/1976 Campbell ..... 315/3
4,531,075 7/1985 Stone ..... 315/3
4,647,815 3/1987 Ishikawa et al. ..... 315/3
4,672,269 6/1987 Kamohara ..... 315/3
4,935,663 11/1990 Shimoma et al. ..... 315/3 X

FOREIGN PATENT DOCUMENTS 0162466 11/1985 European Pat. Off. .
0226145 6/1987 European Pat. Off. .
57-119437 7/1982 Japan .

OTHER PUBLICATIONS

Kazuyoshi Ichimura, "Cathode Ray Tube" Patent Abstracts of Japan, Jul. 24, 1982.

*Primary Examiner*—Eugene R. LaRoche
*Assistant Examiner*—Do Hyun Yoo
*Attorney, Agent, or Firm*—Cushman, Darby & Cushman

[57] ABSTRACT

A cathode ray tube having an electron gun assembly in which a plurality of electrodes constitute an electron beam generating unit for generating electron beams, and an electron lens unit for focusing the generated beams on a predetermined location on a phosphor screen. The electron gun assembly further contains a pair of insulating support rods for supporting the electrodes, a resistor unit for applying a voltage to at least one of the electrodes. A metal ring is mounted in contact with a predetermined electrode of the electron lens unit and surrounds the insulating support rods. Terminal voltage pickup terminals apply a voltage to the resistor unit. At least a first and second intermediate voltage pickup terminal supply a voltage from the resistor unit to a first and second electrode. The first and second intermediate voltage pickup terminals are located in relation to the metal ring such that a discharge is prevented and image quality is preserved.

5 Claims, 6 Drawing Sheets

CATHODE RAY TUBE

BACKGROUND OF THE INVENTION

1. Field of the Invention

The present invention relates to a cathode ray tube and, in particular, a cathode ray tube for applying a predetermined voltage to a corresponding electrode via a resistor unit which is disposed in the neck of a cathode ray tube.

2. Description of the Related Art

Generally, a color CRT is known as a CRT which is supplied with high voltage. The color CRT, usually, comprises an envelope 3 comprising a panel 1, a funnel 2 and a neck 6, as shown in FIG. 1. A phosphor screen (target) 5 is formed on the inner surface of the panel 1 and a shadow mask 4 is provided opposite to the phosphor screen (target) 5 which is composed of a three-color phosphor layer for emitting R (red), B (blue) and G (Green) light. At a time of use, a deflection yoke 20 is mounted near a boundary between a funnel 2 and a neck 6.

An electron gun assembly 7 is located in the neck 6 to emit three electron beams 9. The electron gun assembly 7 is composed of a plurality of electrodes, such as a cathode serving as an electron beam generating section, an electrode for controlling the generation of the electron beams 9 emitting from the cathode, and an electrode for focusing the electron beams toward the phosphor screen at accelerated speed. It is necessary to supply a high anode voltage of about 25 to 30 KV and medium voltage of about 5 to 8 KV (focusing voltage) to the corresponding electrodes.

A voltage which is to be applied to the associated electrode in the electron gun assembly 7 is applied there via a corresponding stem pin 17 which extends through a stem section 6*a* of the neck 6 in airtight fashion, noting that anode voltage is applied via an inner conductive film 16 which is formed on the inner surface of an anode terminal 8 and funnel 2. Supplying a medium voltage, such as a focusing voltage, via the stem section 6*a* poses a "arcing or flashover" problem as involved at a supply section such as a socket which is connected to the stem pin 17. This causes a complex structure.

A way for obtaining a requisite medium voltage through the division of anode voltage which is made by a resistor unit located within the CRT is disclosed in Japanese Utility Model Disclosure (KOKAI) Nos. 48-21561 and 55-38484 and U.S. Pat. Nos. 3,932,786 and 4,413,298. However, there is no adequate space for the resistor unit to be arranged within the CRT. For this reason, the resistor unit is located in a small space in the neck 6 such that it is situated near the electron gun assembly 7.

FIG. 2 is one form of an electron gun assembly having a resistor unit arranged in it. In an arrangement shown in FIG. 2, reference numeral 7 denotes electron gun assembly 10*a*, 10*b*, 10*c* (10*b*, 10*c* hidden from view in FIG. 2), heaters; 11*a*, 11*b*, 11*c* (11*b*, 11*c* hidden from view in FIG. 2), cathodes; G1, G2, G3, G4 and G5, first, second, third, fourth and fifth grids, respectively; 12, a shield cup; 13*a*, 13*b*, a pair of insulating support rods; 15, a spacer; 16, an inner conductive film and 17, a stem pin.

In the electron gun assembly 7, a resistor unit 14 is located at the back surface of the insulating support rod 13*a*.

The resistor unit 14 is formed as shown in FIG. 3. In the arrangement shown in FIG. 3, 18 denotes an insulating board; 19, a high resistance section; T1 . . . T4, voltage pickup terminals; and CN, a connector.

If the resistor unit 14 is arranged in a narrow space in the neck 6 such that it is located near the electron gun assembly 7, a relatively complex potential distribution is created in the space in the neck of the CRT, which is caused by a potential on each electrode in the electron gun assembly 7 and on the inner conductive film 16. For this reason, a problem occurs as set out below.

That is, since the surface of the neck 6 and those of the insulating support rods 13*a*, 13*b* and resistor unit 14 are formed with an insulating material, electrons leaking from an "electrode side" opening of the electron gun assembly 7 as well as electrons emitted from the electrode in the presence of a strong electric field are accelerated from a low to a high potential zone. Upon the collision of electrons on the insulating material as set forth above, many secondary electrons are generated, moving toward the high potential section while increasing in number. As a result, a greater discharge occurs, sometimes destroying a drive circuit for the CRT, the resistor unit 14, insulating support rods 13*a*, 13*b* and so on.

Even in the case where no greater discharge takes place, a tiny steady discharge may occur between the aforementioned material and the electrode. At that time, bluish white light is observed as a discharge, causing a variation in the potential on the insulating material as set forth above and in a potential distribution around the insulating material. This variation exerts an adverse effect upon an electron lens, thus degrading an electron beam spot configuration on the phosphor screen 5 and hence reducing image quality.

As a solution to the problem as set out above, Japanese Patent Disclosure (KOKAI) 57-119437 discloses the technique of using a metal ring for surrounding such an insulating support rod against a low or a medium potential electrode. Even in the arrangement shown in FIG. 2, a metal ring SR is placed at that location of the third grid G3 as near to an electrode pickup terminal T3 as possible to surround the insulating support rods 13*a*, 13*b* and resistor unit 14 with it. The metal ring SR is heated to form an evaporated matter on the inner wall of the neck 6. In FIG. 2, reference numeral 101 denotes a metal evaporation film, that is the evaporated matter.

In the arrangement using such a technique, an electric field still stays strong in the area of the resistor unit 14 which is situated near an electrode pickup terminal T2. A tiny discharge is developed between an involved location near to the electrode pickup terminal T2 and the metal deposition film 101 on the inner wall of the neck and between that and the insulating support rods 13*a*, 13*b*, causing a variation in a division voltage on the resistor unit 14. The variation of the division voltage fails to exhibit a given performance of an electronic lens. It is, therefore, not possible to prevent a deterioration in an electron beam spot pattern on the phosphor screen 5 and in an image quality.

In the case where a given voltage is applied to a corresponding electrode on the electron gun assembly 7 through a given division resistance on the resistor unit 14 which is located near the electron gun assembly 7 in the narrow space of the neck 6, if such a metal ring SR is used so as to prevent the occurrence of a discharge in the neck 6, there is less beneficial result in the event of the resistor unit's voltage pickup terminal being higher in voltage than the metal ring SR, failing to achieve complete prevention of a discharge in the neck 6 of the color CRT, that is, to achieve a normal operation of the color CRT.

SUMMARY OF THE INVENTION

It is accordingly the object of the present invention to provide a cathode ray tube of high reliability and practical use which effectively prevents an unwanted discharge in a neck of a CRT and improves the arcing or flashover characteristics.

The cathode ray tube according to the present invention comprises an electron gun assembly including a specific resistor unit. The resistor unit includes a voltage pickup terminal through which a voltage is applied to at least one of those electrodes constituting a main lens unit. A metal ring surrounds insulating support rods that support the electrodes. The voltage pickup terminal is mounted in contact with a predetermined electrode in the main lens unit and is located on the side of the metal ring nearer to an electron beam generation unit. A potential on the metal ring is made lower than a potential on the mentioned voltage pickup terminal.

BRIEF DESCRIPTION OF THE DRAWINGS

FIG. 9(*b*), is a cross-sectional view, partly taken away, showing a neck of a cathode ray tube according to another embodiment of the present invention; and FIG. 9(*c*), is a graph showing a potential on the inner wall of the neck of a CRT according to the present invention and that on the neck of a conventional CRT.

DETAILED DESCRIPTION OF THE PREFERRED EMBODIMENTS

Figure 4:
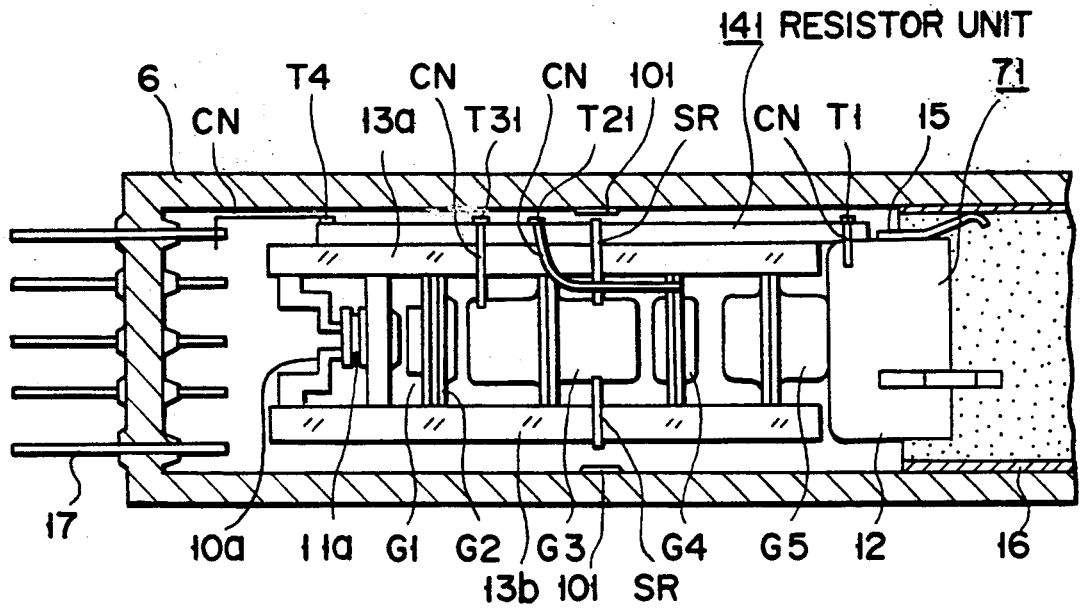
FIG. 4 is a cross-sectional view showing a neck of a cathode ray tube according to on embodiment of the e present invention.
Figure 5:
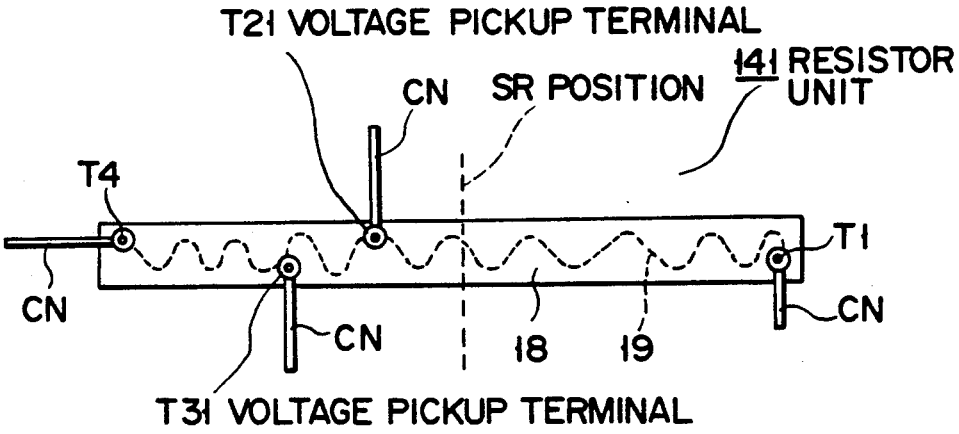
FIG. 5 is a plan view showing a resistor unit in FIG. 4.

A CRT of the present invention, such as a color CRT, includes such a neck arrangement as shown in FIGS. 4 and 5. In FIG. 4, reference numeral 71 denotes an electron gun assembly and in FIG. 4 and FIG. 5, 141 denotes a resistor unit.

The electron gun assembly 71 is of such an in-line type that a center beam and a pair of side beams are emitted through a common plane. The electron gun assembly 71 includes three cathodes 11*a*, 11*b* and 11*c* (11*b*, 11*c* hidden from view in FIG. 4), in an in-line array, containing heaters 10*a*, 10*b* and 10*c* (10*b*, 10*c* hidden from view in FIG. 4), respectively, and a ... n lens unit including a first grid G1, second grid G2, third grid G3, fourth grid G4 and fifth grid G5, and a shield cup 12, all of which are mounted by a pair of parallel insulating support rods (glass support rods) 13*a*, 13*b* in that order.

In particular, the electron gun assembly 71 shown includes the third grid G3 of a longer length and fourth grid G4 of a shorter length, and provides a longer focusing lens for allowing a gradual potential gradient to be created over a length from the third grid G3 to the fifth grid G5. The electron gun assembly 71 includes the resistor unit 141 which is mounted on the back surface of one (13*a*) of the insulating support rods 13*a*, 13*b*.

In FIG. 4, a spacer 15 is welded at one end to the shield cup 12 and at the other end to an inner conductive film 16 which is coated on the inner surface of a CRT's funnel. A high anode voltage is applied to an anode terminal and transferred to the fifth grid G5 via the shield cup 12. A stem pin 17 extends, in an airtight region, through a stem section at the end of the neck 6. A metal ring SR is located on the third grid G3 such that it surrounds the insulating support rods 13*a*, 13*b* and resistor unit 141.

The resistor unit 141 is dimensioned, for example, as being 60 mm long×5.0 mm wide×1.0 mm thick and comprises, as shown in FIG. 5, an insulating substrate 18 extending from the electron gun cathodes 11*a*, 11*b*, 11*c* to a location over the shield cup 12, a high resistance section 19 of about 1000 MO which is made of a mixture of glass with ruthenium oxide and zigzag formed on one surface of the insulating sheet 18, an insulating film about 50 to 200 μm thick which is formed as a thin glass film to cover the high resistance section 19, voltage pickup terminals T1, T21, T31, T4 which have a through hole, each, extending through the opposite faces of the insulating substrates 18 and which is composed of a low resistance section of about a few kiloohms (KQ) containing ruthenium oxide as a principal component and connected to the high resistance section 19 on the surface of the insulating substrate 18, and connection means composed of an eyelet-equipped cylindrical metal piece and connected to the low resistance section such that, for example, it is riveted there through the through hole.

The resistor unit 141 is electrically and mechanically fixed to the back surface of the insulating support rod 13*a* by connecting one end of a connector CN, such as a ribbon-like metal, which is welded to the connection means, to the corresponding electrode and stem pin 17.

In the embodiment shown in FIGS. 4 and 5, the resistor 141 is connected by the connectors to the shield cup 12, fourth grid G4, third grid G3 and stem pin 17. A high anode voltage of 25 to 30 KV is applied to the shield cup 12 via the anode terminal 8, inner conductive film 16 and spacer 15 and divided by the resistor unit 141 such that about 12 KV and about 6 KV are applied to the fourth grid G4 and third grid G3, respectively.

The resistor unit 141 has the voltage pickup terminals T1 and T4 and the two voltage pickup terminals T21 and T31 located between the voltage pickup terminals T1 and T4. In the embodiment of the present invention, the voltage pickup terminal T21 which supplies a medium or a high potential to the fourth grid G4 is displaced nearer to the cathodes 11*a*, 11*b*, 11*c*. The metal ring SR surrounds the resistor unit 141 and insulating support rods 13*a* and 13*b* against the third grid G3 such that it is displaced nearer to the "fourth grid G4" side. Thus the voltage pickup terminal T21 is located nearer to the "stem pin" side with the metal ring SR as a reference upon being compared with the conventional counterpart.

Furthermore, an anode voltage of, for example, 25 KV is supplied to the shield cup 12 and fifth grid G5 and also to the voltage pickup terminal T1 on the resistor unit 141. 12 KV and 6 KV are applied as a divided voltage to the voltage pickup terminals T21 and T31, respectively, and the voltage pickup terminal T4 on the resistor unit 141 is grounded outside the CRT.

A voltage 12 KV on the voltage pickup terminal T21 is applied to the fourth grid G4 and a voltage 6 KV on the voltage pickup terminal is applied to the third grid G3.

In the present embodiment, the voltage pickup terminal T21 on which 12 KV appears is located on the cathode (11*a*, 11*b*, 11*c*) side with the metal ring SR as a reference, noting that the metal ring SR is placed at the same voltage as that (6 KV) on the third grid G3 in this instance. Since the voltage pickup terminal T21 is located nearer to the third grid G3, in particular, on which 6 KV emerges, a maximum potential difference becomes 12 KV−6 KV=6 KV.

Figure 1:
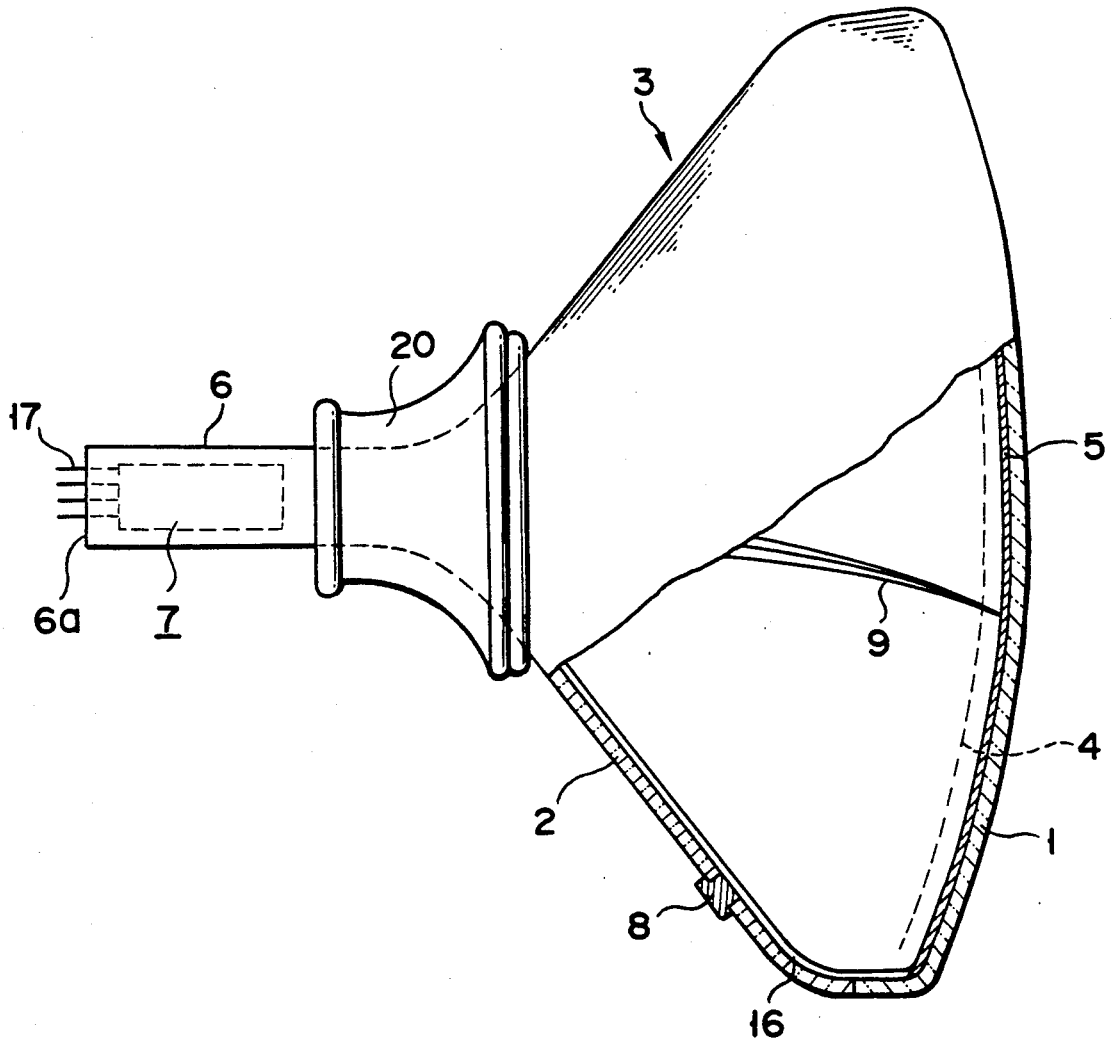
FIG. 1 is a view, partly taken away, showing a whole of an ordinary cathode ray tube.
Figure 2:
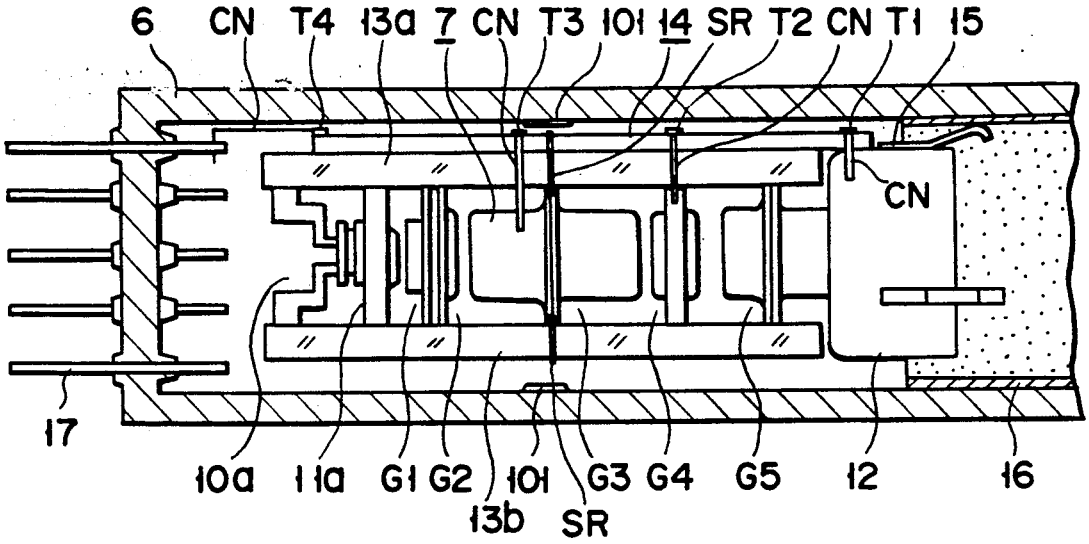
F I G. 2 PRIOR ART
FIG. 2 is a cross-sectional view showing a neck of a conventional cathode ray tube.
Figure 3:
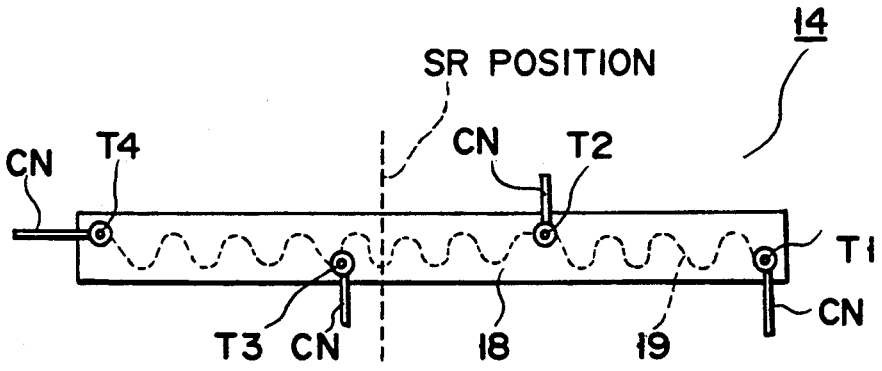
F I G. 3 PRIOR ART
FIG. 3 is a plan view showing a resistor unit in FIG. 2.

In the conventional case shown in FIG. 2, since the voltage pickup terminal T2 is located nearer to a high anode voltage side than the counterpart of the present invention, a maximum potential difference therebetween becomes 25 KV−12 KV=13 KV, a nearly double voltage level upon being compared with that of the present invention.

Since 12 KV−6 KV=6 KV, nearly half level upon being compared with that of the conventional counterpart, the strength of an electric field is largely decreased in the neighborhood of the voltage pickup terminal of interest, effectively suppressing development of a discharge.

Figure 9A:
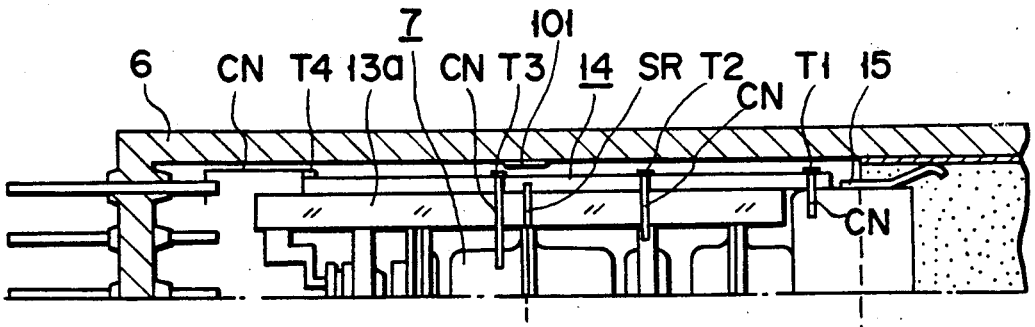
FIG. 9(*a*) is a cross-sectional view, partly taken away, showing a neck of a conventional cathode ray tube.
Figure 9B:
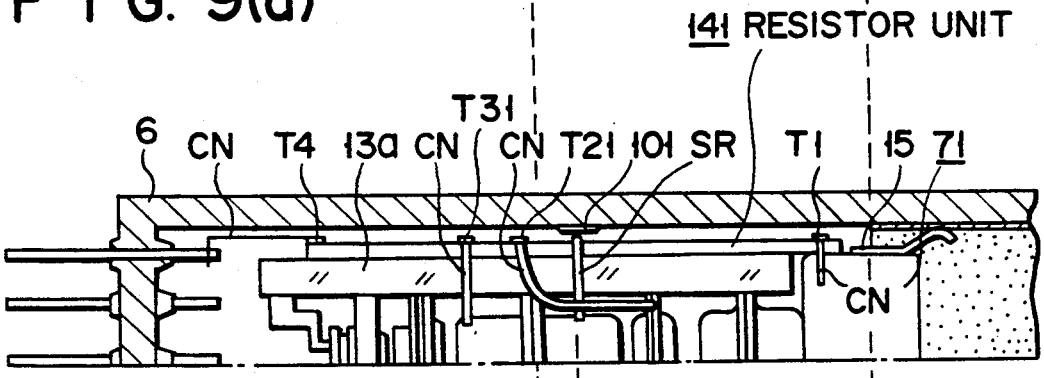
Figure 9C:
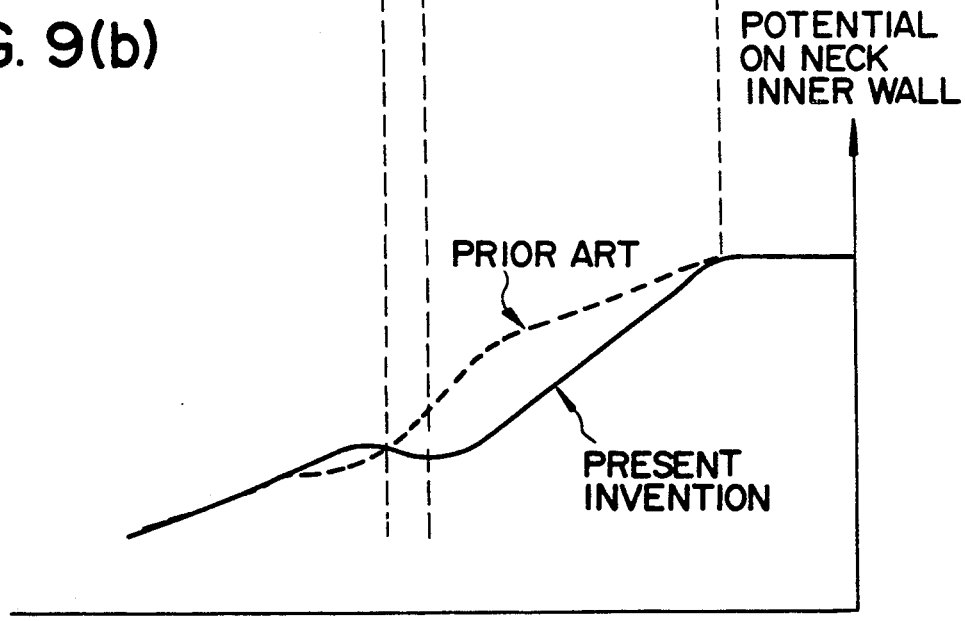

A relation of a potential on the inner wall of the neck in the conventional case to that in the present invention will be explained below with reference to FIGS. 9(*a*) through 9(*c*). FIG. 9(*a*) is a partial, cross-sectional view showing the neck of the conventional cathode ray tube, FIG. 9(*b*) is a partial, cross-sectional view showing a neck of a CRT of the present invention, and FIG. 9(*c*) is a graph showing a potential on the inner wall of the CRT's neck upon being compared between the prior art and the present invention.

Generally, the potential on the inner wall of the CRT's neck is distributed as a potential profile gradually lowered toward the cathode side with a high voltage on an inner conductive film emerging as a maximal value. In the prior art shown in FIG. 9(*a*), a potential profile has a curve such that the potential is gradually lowered toward the cathode side, as indicated by the dotted line in FIG. 9(*c*), except that it has a somewhat high potential area corresponding to the voltage pickup terminal T2 and a largely dropped potential area corresponding to the metal ring SR.

In the potential profile as indicated by the solid line in FIG. 9(*c*), the "SR" potential area is shifted toward a "high potential" side and the "T21" potential area toward the "cathode" side, so that a potential curve on the inner wall of the CRT's neck is made considerably lower than that of the prior art.

Furthermore, the potential curve increases somewhat at the "T21" area and is gradually lowered toward the "cathode" side, except that the "T21" potential area is almost equal to that of the prior art since it is suppressed by an effect of the metal evaporation film.

Normally, the surface of the insulating support insulating material such as glass and there is a ready charge buildup and a greater secondary-electron emission ratio, thus leading to unwanted ready occurrence of a sustained discharge. The electrode-to-electrode discharge is less likely to occur since both the electrodes are formed of metal.

Since it is possible to effectively prevent a high anode voltage as at the metal ring SR from penetrating toward the "stem" side, the positioning of the voltage pickup terminal T21 toward the "stem" side with respect to the metal ring SR places the voltage pickup terminal T21 and its neighborhood at a stable potential. It is thus possible to suppress the development of a discharge phenomenon.

Figure 6:
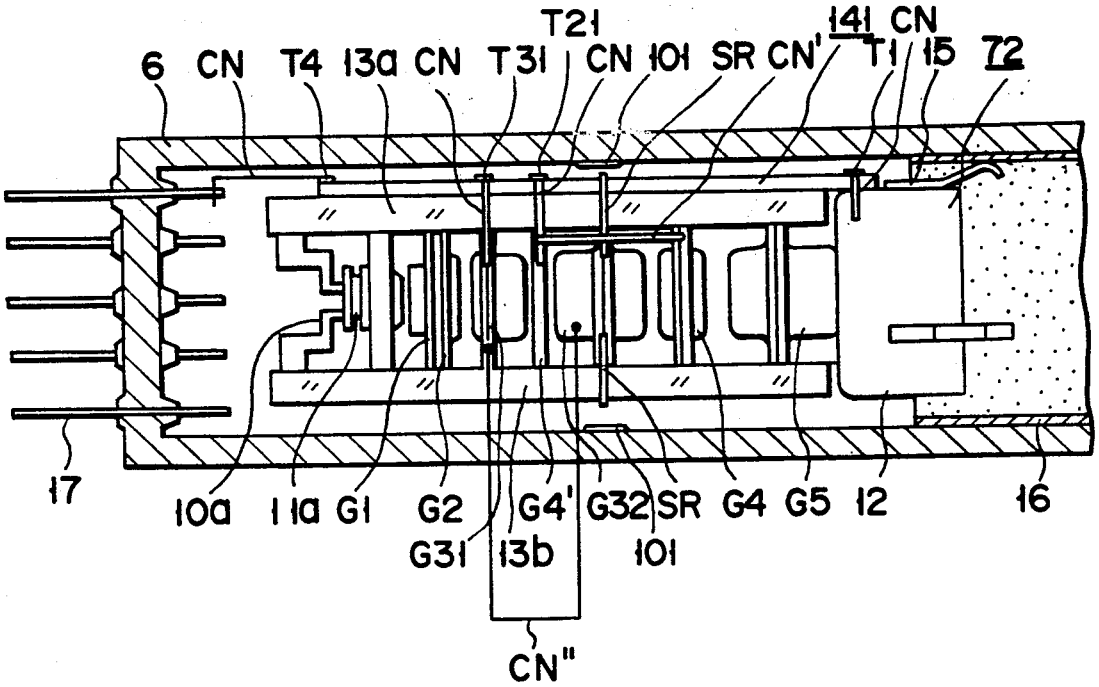
FIG. 6 is a cross-sectional view showing a neck of a cathode ray tube according to another embodiment of the present invention.

FIG. 6 shows the neck of a CRT according to another embodiment of the present invention. According to this embodiment, it is possible to gain the same effect as that of the previous embodiment.

As shown in FIG. 6, an electron gun assembly 72 is third unit grids G31 and G32 with a fourth grid G4' (thin sheet) located therebetween and that a voltage pickup terminal T21 on the resistor unit 141 is connected by a connector CN to the fourth grid G4'.

The third unit grid G31 is connected to the third unit grid G32 by another connector CN" as indicated by a heavy line (for the sake of illustration only) in FIG. 6.

Since, in this case, the fourth grid G4' is made thin or the beam opening diameter is made greater than the size of the third unit grids G31 and G32, an electronic lens defined by the third unit grid G31, fourth grid G4' and third unit grid G32 has a less effect and exerts almost no effect upon the focusing property of the electron gun assembly 72.

Alternatively, the fourth grid G4' is made somewhat thick and a uniform lens is positively defined by the third unit grid G31, fourth grid G4' and third unit grid G32 whereby it is possible to effectively improve the focusing property of the electron gun assembly 72.

Connecting the voltage pickup terminal on the resistor unit 141 to the fourth grid G4' by a longer connector CN causes an instability and hence a difficulty in the manufacture of CRTs. This problem can be solved by arranging associated component parts as specifically shown in FIG. 6.

Figure 8:
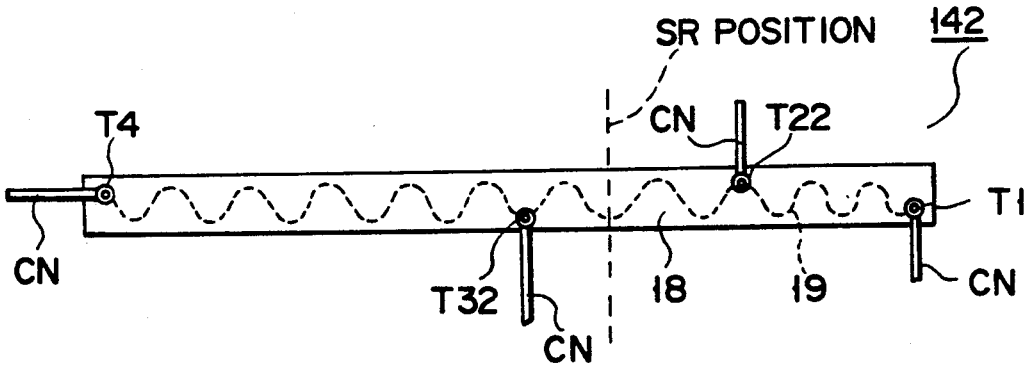
FIG. 8 is a plan view showing a resistor unit in FIG. 7.
Figure 7:
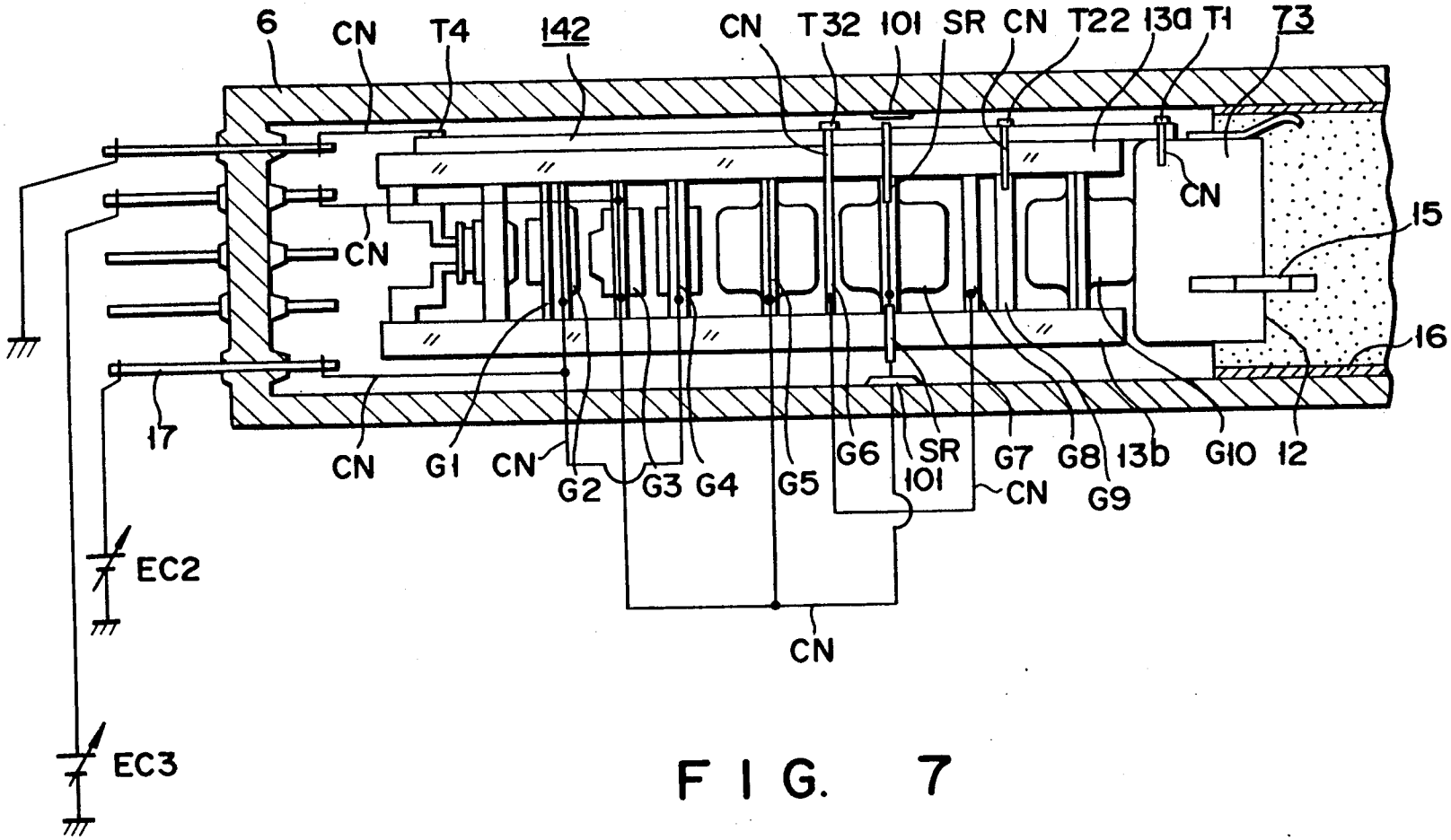
FIG. 7 is a cross-sectional view showing a neck of a cathode ray tube according to another embodiment of the present invention.

FIGS. 7 and 8 show the neck of a CRT according to another embodiment of the present invention. This embodiment also gains the same effect as set out above in conjunction with the previous embodiment.

In the arrangement shown in FIG. 7, the electron gun assembly 73 in the neck of the CRT is the same up to a second grid G2 as the previous embodiment shown in FIG. 2, but more electrodes are used in the rest of the CRT's neck, that is, third grid G3, fourth grid G4, fifth grid G5, sixth grid G6, seventh grid G7, eighth grid G8, ninth grid G9, tenth grid G10 and shield cup 12. These electrodes (grids) are fixed on a pair of insulating support rods 13*a*, 13*b* such as glass and a resistor unit 142 is mounted on the back side of one (insulating support rod 13*a*) of the insulating support rods.

As shown in FIG. 8, the resistor 142 includes a first voltage pickup terminal T1 thereon which is connected by a connector CN to the shield cup 12. The second voltage pickup terminal T22 is connected by a connector CN to the ninth grid G9 in side-by-side fashion. The third voltage pickup terminal T32 is connected by a connector CN to the sixth grid G6 in side-by-side fashion. The fourth electrode pickup terminal T4 is similarly connected by a connector CN to a corresponding stem pin 17 and grounded, or connected to a low pential source, outside the CRT's neck.

The third grid G3 is connected by a connector CN to the fifth grid G5 and seventh grid G7 and by a connector CN to a corresponding stem pin 17. The third grid G3 is supplied with a voltage EC3 of 8 to 10 KV from outside the CRT.

For ease in understanding, portions of the connectors are shown outside the neck.

The fourth grid G4 is connected by a connector CN to the second grid G2 and the second grid G2 is connected by a connector CN to a corresponding stem pin 17 and supplied with a voltage EC2 of 500 V to 1 KV from outside the neck.

The sixth grid G6 is connected by a connector CN to the eighth grid G8.

A high anode voltage of 25 to 30 KV is applied via an envelope spacer 15 to the tenth grid G10 and shield cup 12. A voltage of about 20 KV is applied by the resistor unit 142 to the ninth grid G9 and a voltage of about 12 KV is applied by the resistor unit 142 to the eighth grid G8 and sixth grid G6.

The lengths of the respective electrodes are, for example, as follows:

G3l≈3.2 mm, G4l≈2.0 mm, G5l≈8.0 mm, G6l≈0.25 mm, G7l≈8.0 mm, G8l≈2.0 mm, G9l≈2.0 mm, and G10l≈7.5 mm.

In this case, the respective electrodes are each spaced 0.6 mm apart and the electron beam passage hole is about 6.2 mm in diameter.

The sixth grid G6 is formed of a very thin electrode and there is almost no lens function among an array of the fifth grid G5, sixth grid G6 and seventh grid G7.

It has been reported by the inventors that a lens performance is improved at a lens structure of G3–G4–G5 and G7–G8–G9–G10.

In another embodiment of the present invention, a metal ring SR which is mounted on the seventh grid G7 surrounds insulating support rods 13*a*, 13*b* or resistor unit 142 and a metal evaporation film 101 is formed at a corresponding location on the inner wall of the neck 6 of the CRT.

Since the metal ring SR is mounted on the seventh grid G7 and the third voltage pickup terminal T32 on the resistor unit 142 which supplies a potential of the eighth grid G8 is located nearer to the metal ring SR with the metal ring SR as a reference, a maximal potential difference in the neighborhood of the third voltage pickup terminal T32 appears as only a very small potential difference of 2 to 4 KV across the fifth and seventh grids G5 and G7, obtaining a prominent discharge suppression effect.

At this time, a potential on the second voltage pickup terminal T22 is nearer in level to a high anode voltage and better located rather than on the other side of ring SR producing a small potential difference.

In the prior art, the fifth grid G5 is continuous with the seventh grid G7 with no aforementioned sixth grid G6 located therebetween, and the third voltage pickup terminal T32 is situated just close to the eighth grid G8 and hence at a location nearer to the anode side with the metal ring as a reference. As a result, a maximal potential difference of about 10 KV emerges in that neighborhood. Furthermore, that potential difference increases due to the penetration of the high anode voltage from the anode side into that zone. For this reason, a discharge is likely to occur.

Experiments have been conducted using the CRTs of the present invention and it has been found that, as shown in Table 1 below, no discharge occurs in the neighborhood of the third voltage pickup terminal T32 to obtain a CRT of very high reliability.

TABLE 1

| | Occurrence of discharge |
|---|---|
| prior art | about 10% |
| present invention | 0% |

According to the present invention, as set out above, a high-voltage pickup terminal on the resistor unit is located nearer the cathode side and the metal ring extending from a low-potential electrode surrounds the insulating support rod and resistor unit, thus lowering a potential on the inner wall of the neck and, in particular, lowering an electric field in the neighborhood of a higher-voltage pickup terminal on the resistor unit. As a result, it is possible to largely suppress occurrence of a discharge in the neck of the CRT It is thus possible to initially prevent any abnormal operation or a breakage resulting from an unwanted discharge in the cathode ray tube or to prevent any adverse effect of such a discharge upon an associated drive device, thereby providing a cathode ray tube of high reliability.

What is claimed is:

1. A cathode ray tube having a neck with an electron gun assembly comprising:

a plurality of electrodes forming an electron beam generating unit for generating electron beams, and an electron lens unit for receiving and focusing the electron beams on a predetermined location on a phosphor screen;

insulating support rods for supporting the electrodes;

terminal voltage pickup terminals at both ends of a resistor unit creating a voltage potential across said resistor unit;

at least a first and second intermediate voltage pickup terminal for supplying a voltage potential on said resistor unit to at least a first and second electrode;

a metal ring mounted in contact with a predetermined electrode on the electron lens unit and surrounding the insulating support rods, wherein said intermediate voltage pickup terminals are located on said resistor unit in relation to said metal ring for preventing discharge between said intermediate voltage pickup terminals and the neck of the cathode ray tube.

2. The cathode ray tube according to claim 1, wherein the resistor unit provides means for causing a potential on said metal ring to be lower than a potential on one of the first and second intermediate voltage pickup terminals.

3. The cathode ray tube according to claim 1, wherein said plurality of electrodes comprise first, second, third, fourth and fifth grids, said third grid is divided into two third unit grids, and another fourth grid is located between the two third unit grids and is electrically connected to one of the first and second intermediate voltage pickup terminals.

4. The cathode ray tube according to claim 1, wherein said plurality of electrodes comprise first, second, third, fourth, fifth, sixth, seventh, eighth, ninth and tenth grids, said second grid is electrically connected to said fourth grid, said third, fifth and seventh grids are electrically connected to each other, said sixth grid is electrically connected to said eighth grid, and said sixth grid is electrically connected to a one of the first and second intermediate voltage pickup terminals.

5. The cathode ray tube according to claim 1, wherein said electron lens unit is a main lens unit.

* * * * *